US007621090B2

(12) United States Patent
Kelley et al.

(10) Patent No.: US 7,621,090 B2
(45) Date of Patent: Nov. 24, 2009

(54) PANEL AND MOUNTING MECHANISM

(75) Inventors: James K. Kelley, Lancaster, PA (US); Peter P. Arena, Jr., Columbia, PA (US); Eric Krantz-Lilienthal, Lancaster, PA (US)

(73) Assignee: AWI Licensing Company, Wilmington, DE (US)

( * ) Notice: Subject to any disclaimer, the term of this patent is extended or adjusted under 35 U.S.C. 154(b) by 358 days.

(21) Appl. No.: 11/243,124

(22) Filed: Oct. 4, 2005

(65) Prior Publication Data

US 2006/0064939 A1 Mar. 30, 2006

Related U.S. Application Data

(63) Continuation-in-part of application No. 10/764,397, filed on Jan. 23, 2004, now abandoned.

(60) Provisional application No. 60/443,405, filed on Jan. 29, 2003.

(51) Int. Cl.
*E04B 9/06* (2006.01)
*E04B 9/18* (2006.01)

(52) U.S. Cl. ..... 52/506.07; 52/506.09; 52/656.9; 52/715; 52/716.4; 52/716.7; 52/718.04

(58) Field of Classification Search ..... 52/506.07, 52/506.08, 506.09, 506.1, 489.1, 489.2, 656.9, 52/715, 716.4, 716.7, 718.04, 506.06
See application file for complete search history.

(56) References Cited

U.S. PATENT DOCUMENTS

| | | | | | |
|---|---|---|---|---|---|
| 1,997,582 | A * | 4/1935 | Heeren et al. | ..... | 52/145 |
| 2,066,205 | A * | 12/1936 | Keating | ..... | 52/506.09 |
| 2,822,584 | A * | 2/1958 | Urbain | ..... | 52/506.09 |
| 3,303,624 | A * | 2/1967 | Swain | ..... | 52/506.07 |
| 3,381,437 | A * | 5/1968 | Kidney | ..... | 52/779 |
| 3,828,508 | A * | 8/1974 | Moeller | ..... | 52/506.08 |
| 3,963,865 | A * | 6/1976 | Songer | ..... | 380/204 |
| 4,245,442 | A * | 1/1981 | Durham | ..... | 52/126.4 |
| 4,291,783 | A * | 9/1981 | Harris | ..... | 181/295 |
| 4,760,677 | A * | 8/1988 | Nassof | ..... | 52/506.1 |
| 6,101,777 | A * | 8/2000 | Bodine et al. | ..... | 52/506.06 |
| 6,260,325 | B1 * | 7/2001 | Wendt et al. | ..... | 52/506.07 |
| 6,389,771 | B1 * | 5/2002 | Moller | ..... | 52/506.06 |
| 7,010,894 | B1 * | 3/2006 | Cappelle | ..... | 52/480 |
| 7,143,562 | B2 * | 12/2006 | Krantz-Lilienthal et al. | ..... | 52/506.06 |

* cited by examiner

*Primary Examiner*—Richard E Chilcot, Jr.
*Assistant Examiner*—Chi Q Nguyen

(57) ABSTRACT

A ceiling system which includes a plurality of grid elements which form a grid framework and a plurality of downwardly accessible ceiling panels. The ceiling panels include a substrate and at least two mounting members. Each mounting member cooperates with the substrate to provide strength and rigidity characteristics to the substrate and to form a grid receiving cavity. Each mounting member further cooperates with a grid element to accurately position the panel relative to the grid framework. When installed, the system provides no visual indications on how the ceiling panel can be removed.

20 Claims, 11 Drawing Sheets

PANEL AND MOUNTING MECHANISM

CROSS REFERENCE TO RELATED APPLICATIONS

This is a continuous-in-part (CIP) application of a previously filed U.S. application Ser. No. 10/764,397 filed Jan. 23, 2004, now abandoned which application claims the benefit under 35 U.S.C. §119(e) of U.S. provisional application Ser. No. 60/443,405, filed Jan. 29, 2003.

BACKGROUND

The invention relates to a ceiling panel for use with a supporting grid framework in a suspended ceiling. The ceiling panel is of the type that conceals all or part of a grid member when viewed from below. More specifically, the invention is directed to an edge profile for the panel which provides strength sufficient to support a panel substrate of substantial weight or span on adjacent grid members and which allows the panel to be accessible from below.

Ceiling panels are made of various materials, including, but not limited to, mineral fiber, fiberglass, wood, metal and plastic. In addition, ceiling panels either expose the grid or conceal the grid, at least partially, when viewed from below. Ceiling panels which conceal the grid provide several benefits, including their appearance and their ability to lock to the grid. Panels which lock to the grid are especially useful during a fire or a seismic disturbance. Additionally, locked panels, which give no visual indication as to their removal procedure, provide a degree of security against unauthorized access to the space above the ceiling.

Despite the desirable features of panels that conceal and/or lock to the grid, their use has been limited because of problems with installation and removal. Generally, space above the grid is required to install or remove such a panel, which, in turn, reduces the usable room height. Additionally, the conventional installation process for such panels requires the installer to position each panel visually, which, in turn, results in a slowdown in installation.

One ceiling panel that attempts to overcome some of the problems described above is disclosed in U.S. Pat. No. 6,230,463. The ceiling panel shown and described has integrally formed opposed active first and second edges with profiles cut therein which are different from one another, and opposed passive edges. An access kerf and a registration kerf positioned at different levels in the active edges, along with a registration step in one active edge, permit the panel to be inserted or removed by successive hinge actions. When installed, the panel is locked to the ceiling with no visual indications of how the panel can be removed. During the installation, the panel is self-centering and self-aligning.

While the particular configuration shown in U.S. Pat. No. 6,230,463 has many advantages, it may be unacceptable to profile the edges of panel substrates of substantial weight or span, such as wood planking or 4×8 mineral fiber panels, as the edges may not have sufficient strength to support the weight of the panel. Consequently, the panel may sag, warp or otherwise deform, thereby adversely impacting the seamless appearance of the ceiling. In addition, profiling of the edge as taught in the referenced patent requires a relatively complicated cutting tool to insure that all surfaces are properly maintained. As a result, the wear and the maintenance of the tooling can be costly, particularly when the panel is made of wood planking or other like material.

SUMMARY

The invention is directed to a suspended ceiling panel system which includes a grid framework having at least two grid elements which are spaced and are positioned in parallel relation to one another. The system includes a ceiling panel having a substrate and at least two mounting members. The substrate has a first major surface, a second major surface and at least two edges which extend between the first and second major surfaces. The substrate further includes a locating member provided on the first major surface.

In a first example embodiment, the locating member is a recess which extends from the first major surface in a direction toward the second major surface. Each recess extends from its respective edge up to the first major surface and is defined by an interior vertical wall and a bottom horizontal surface. The interior vertical wall extends substantially perpendicular to the bottom horizontal surface.

Each mounting member includes: an attachment section, which can be attached to the substrate at the first major surface; a locating section, which cooperates and engages the locating member of the substrate to locate the mounting member precisely on the substrate; and a hook section which cooperates with and rests upon a grid element when the ceiling panel is installed. The mounting members provide additional strength to, and/or support the weight of, the panel substrate. The mounting members also provide downward accessibility to the panel substrate.

DETAILED DESCRIPTION OF THE DRAWINGS

Figure 1:
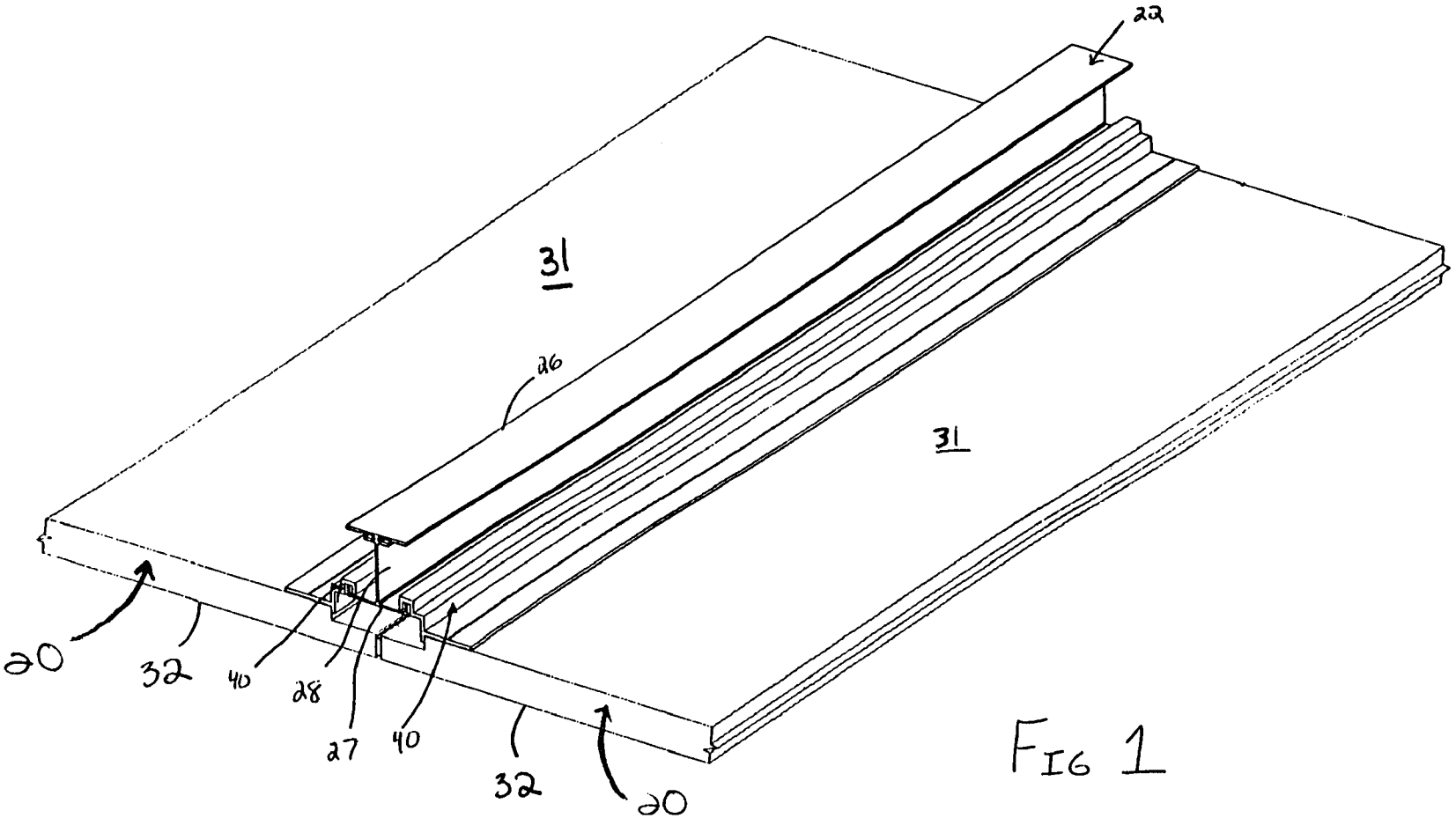
FIG. 1 is a perspective view of a portion of a ceiling system showing two ceiling panels of a first example embodiment.
Figure 2:
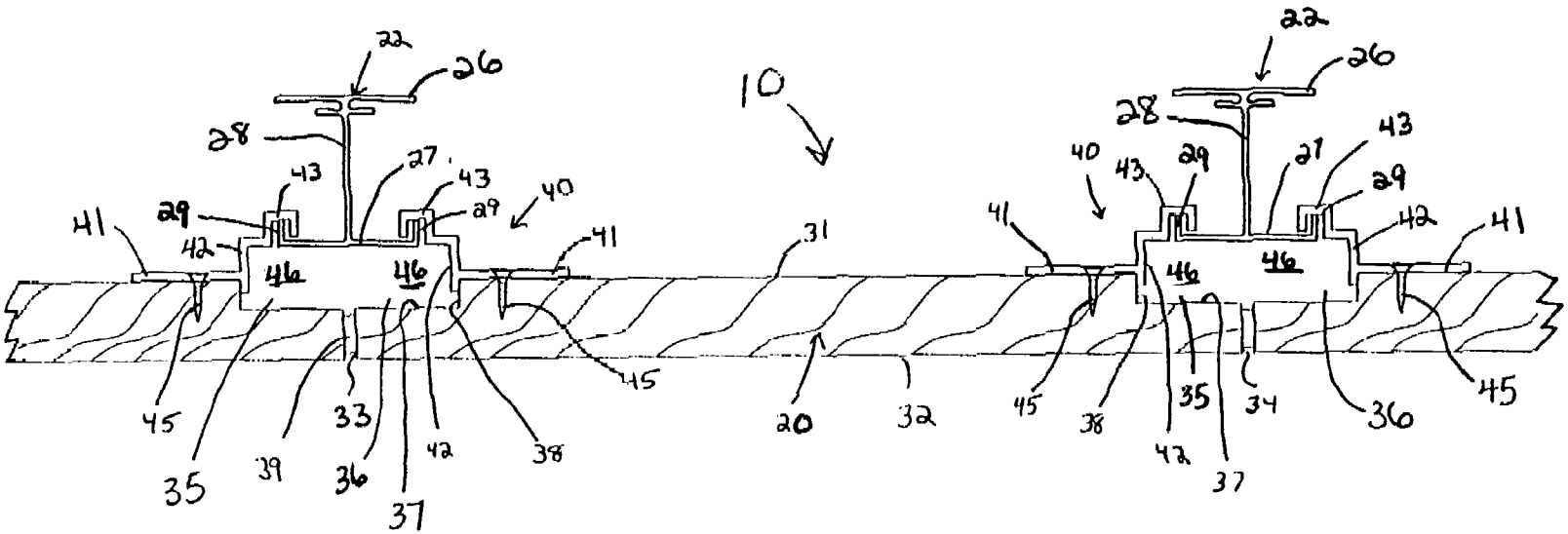
FIG. 2 is a horizontal sectional view of a portion of a ceiling system showing a ceiling panel of the first example embodiment.
Figure 11:
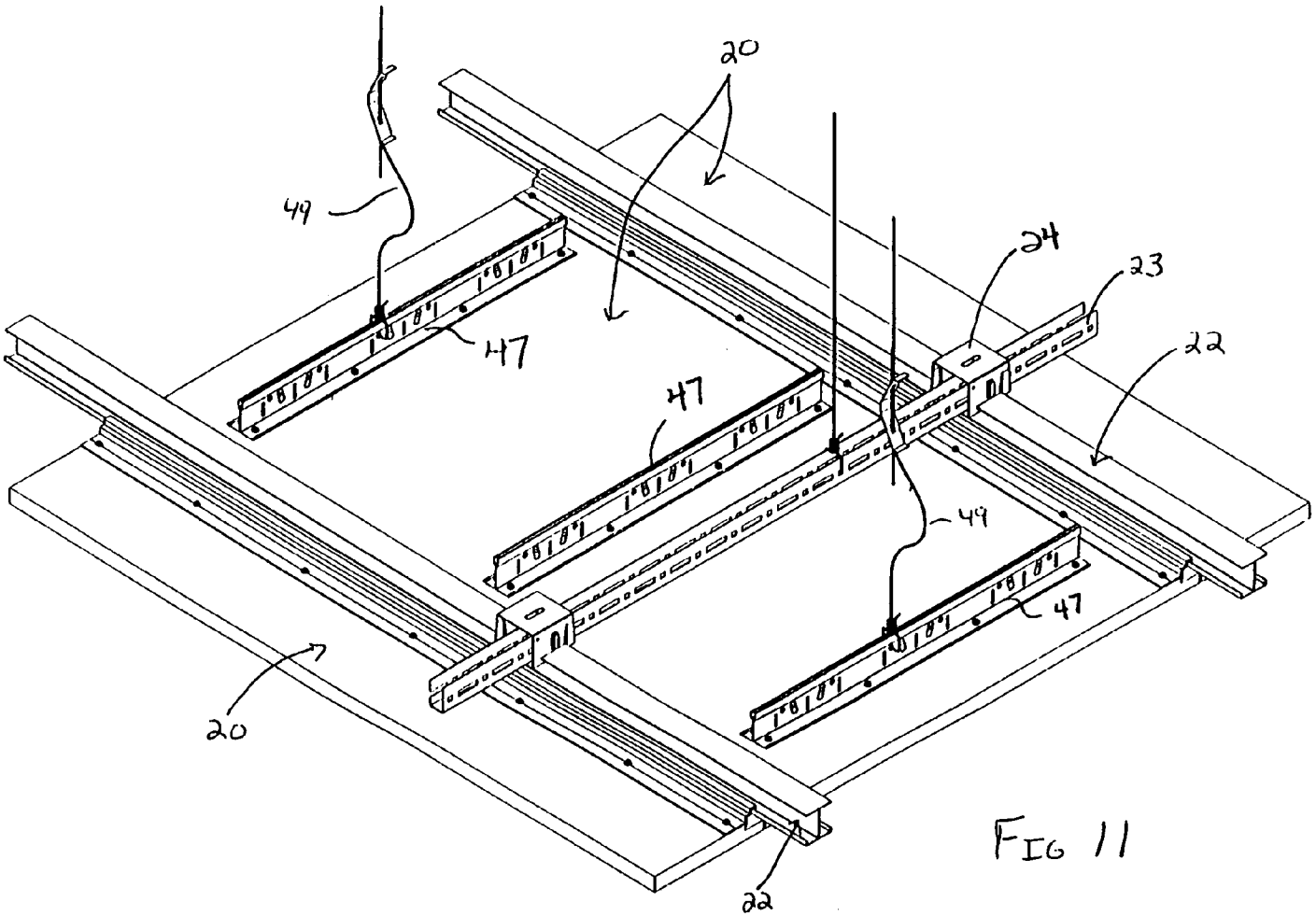
FIG. 11 is a top perspective view of a portion of the ceiling system further illustrating the bracing and hanging elements.
Figure 12:
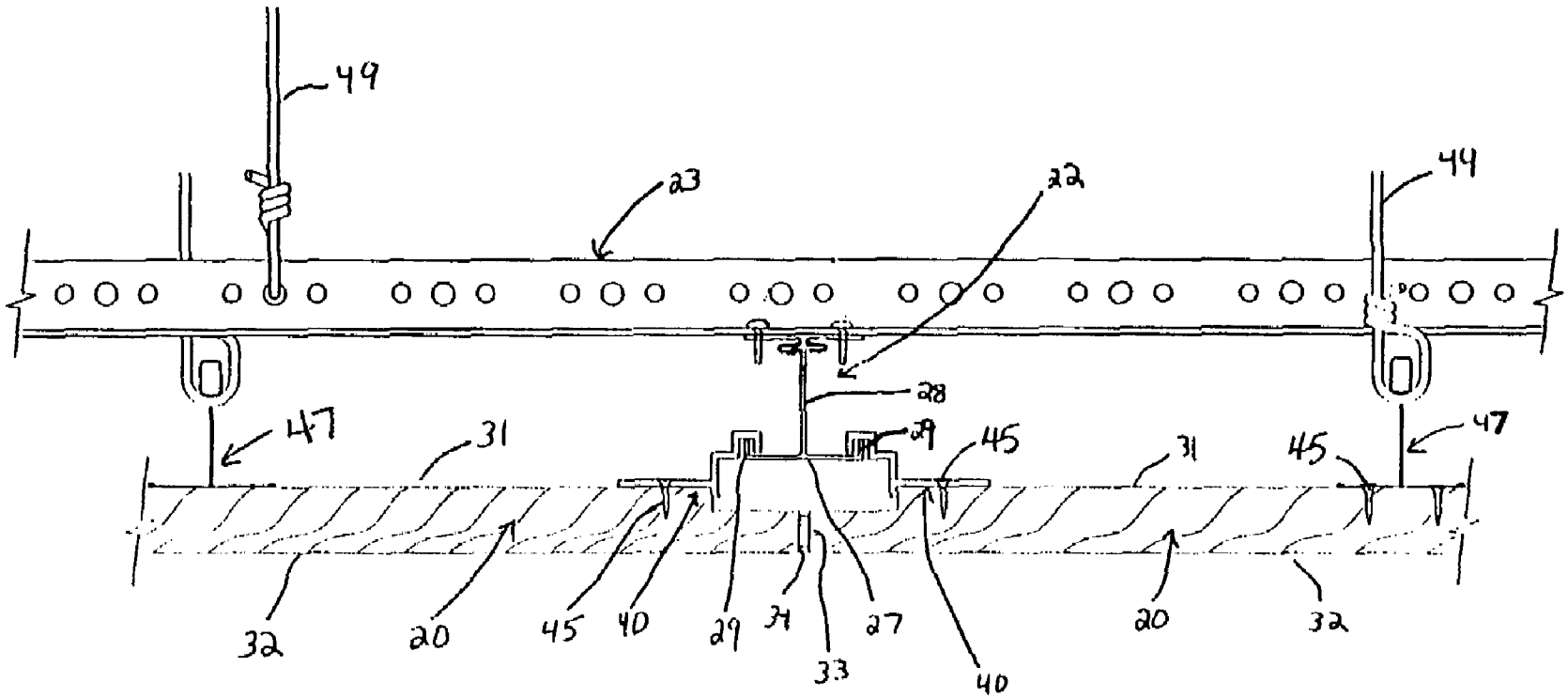
FIG. 12 is a horizontal view of a portion of the ceiling system further illustrating alternative bracing and hanging elements.
Figure 13:
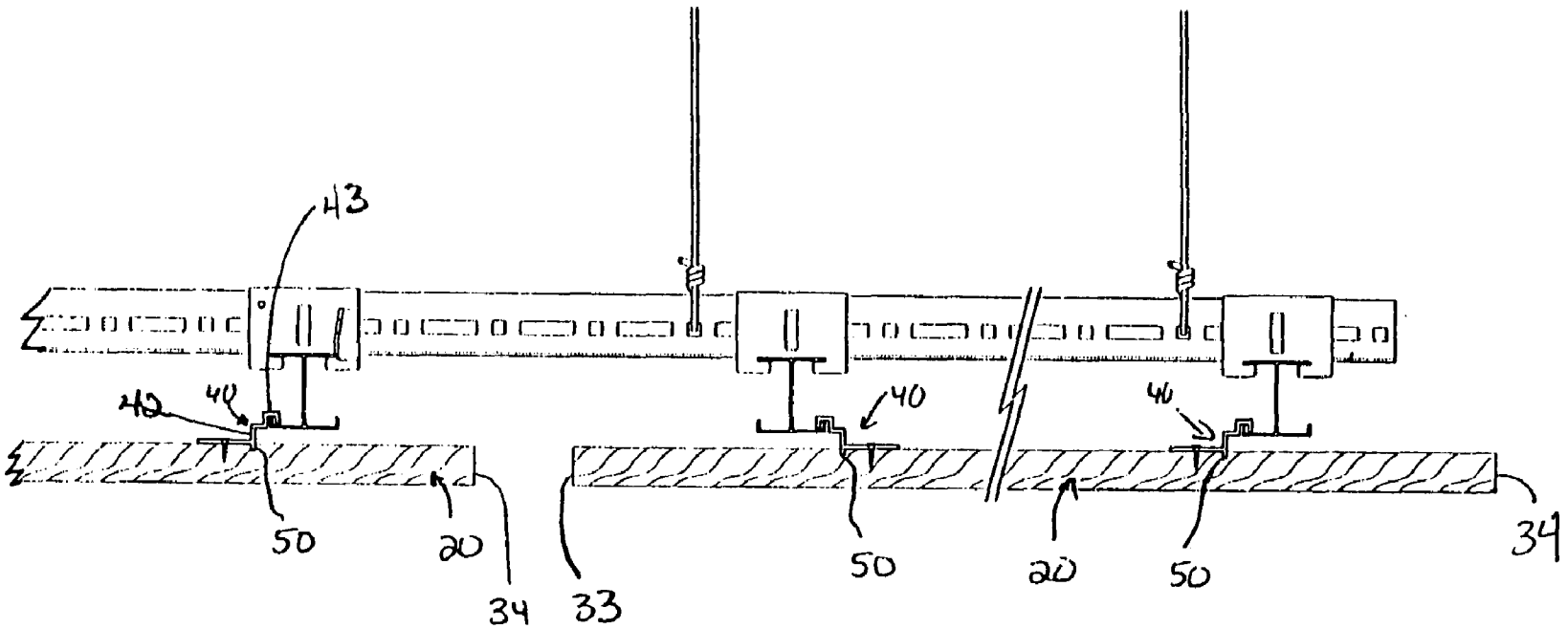
FIG. 13 is a horizontal sectional view of a second alternate ceiling system, showing two alternate ceiling panels positioned on grid members.

In the example embodiment shown in FIGS. 1 and 2, each grid element 22 has a top support 26, a bottom support 27 and a web 28 connecting the top support 26 to the bottom support 27. The top support 26 can have any suitable configuration for mounting the grid element 22 to a support channel or fixed ceiling overhead. The grid elements 22 typically extend in a direction transverse to the supporting channel 23 as shown in FIGS. 11-13, but in any event, form a grid network having two or more grid elements 22 spaced and positioned in parallel relation to one another as shown in FIG. 2. For purposes of illustration, the grid elements 22 which support the ceiling panels of the invention have an H-profile rotated ninety degrees. However, it should be noted that several other profiles, having the features described herein, can be used.

The following description refers to the elements of a ceiling panel when the ceiling panel extends in a horizontal plane. Referring to FIGS. 1 and 2, the ceiling panel 10 includes a panel substrate 20 which has a first major surface 31 and a second major surface 32. The panel substrate 20 has first and second opposed edges 33, 34 which extend between the first major surface 31 and the second major surface 32. Recesses 35 and 36 extend from edges, 33 and 34 respectively, in a direction toward the opposing edge and up to top plane 31. Recesses 35 and 36 are essentially mirror images of one another. In the configuration shown in FIGS. 1 and 2, each recess is defined by a bottom surface 37 and an interior wall 38. The bottom surface 37 is substantially parallel to the first and second major surfaces, 31 and 32, and the interior wall 38 is substantially parallel to edges 33, 34. It should be noted that the panel substrates 20 may be made from various materials, including but not limited to mineral fiber board, fiberglass, wood, metal, plastic or other compositions.

Edges 33 and 34 each have a mounting member 40 attached thereto. The mounting members 40 are manufactured of a material which has the strength and rigidity characteristics that allow it to maintain its shape over time in various environments having different temperature and humidity levels. One such material is extruded aluminum. However, other materials that have the appropriate strength characteristics can be used without departing from the scope of the invention.

Each mounting member 40 includes an attachment section 41, a locating section 42 and a hook section 43. The attachment section 41 is the portion of the mounting member 40 which attaches the mounting member 40 to the panel substrate 20. The attachment section 41 is a substantially flat planar section and extends in substantially perpendicular relation from a locating section 42. When the mounting member is attached to the panel substrate, the attachment section imparts strength and rigidity characteristics to the panel substrate which prevent or at least minimize the propensity of the ceiling panel substrate 20 to sag or warp over time.

The locating section 42 assists in locating the mounting member precisely on a panel substrate 20, as well as, a grid element 22 as will hereafter be more fully described. The hook section 43 extends from the locating section 42 in a direction opposite the attachment section 41. The hook section 43 engages and rests upon the grid element 22 as will be more fully described herein.

Figure 3:
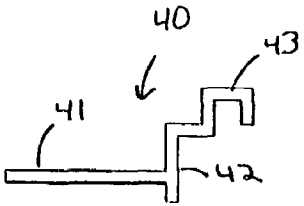
FIG. 3 is a horizontal elevated view of the mounting member shown in FIGS. 1 and 2.
Figure 6:
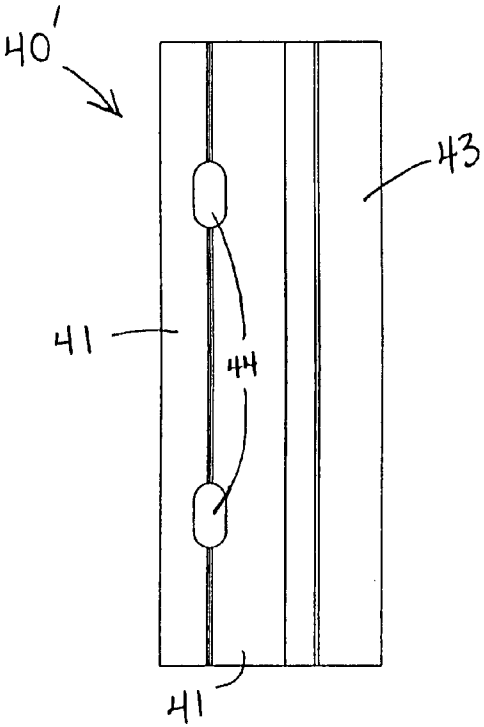
FIG. 6 is a top plan view of the alternate configuration of the mounting member shown in FIG. 5.
Figure 5:
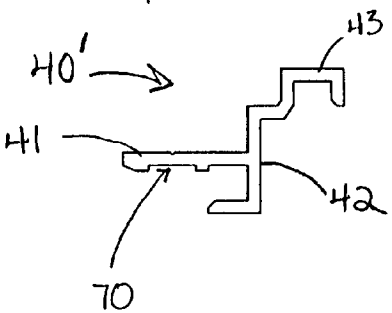
FIG. 5 is a horizontal elevated view of an alternate configuration of the mounting member.

To form the ceiling panel 10, the mounting member 40 is moved into engagement with the panel substrate 20. More specifically, each mounting member 40 is positioned precisely on the panel substrate 20 such that the bottom surface of at least a portion of the attachment section 41 abuts the first major surface 31 and the locating section 42 abuts with the interior wall 38 of a recess, i.e. recess 35 or 36. In the example embodiment shown in FIGS. 1-3, the attachment section 41 of the mounting member 40 is configured such that the entire bottom surface of the attachment section 41 is contiguous the first major surface 31 of the panel substrate 20. As the positioning and dimensions of the interior wall 38 are controlled during the manufacture of the panel substrate 20, the engagement of the locating section 42 and the interior wall 38 insures that the mounting member 40 is precisely positioned relative the panel substrate 20.

Figure 4:
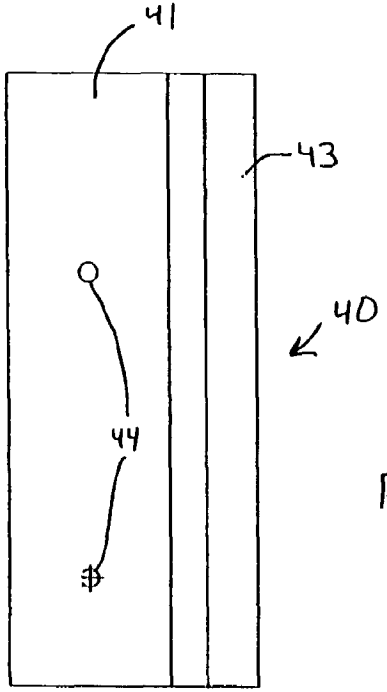
FIG. 4 is a top plan view of the mounting member shown in FIG. 3.

With the mounting member 40 properly positioned on the panel substrate 20, the mounting member 40 can be fixedly attached to the panel substrate 20 by a mechanical fastener or a chemical adhesive. In the example embodiment shown in FIG. 2, a screw-type fastener 45 is inserted through a mounting opening 44 (FIGS. 3 and 4) extending through the attachment section 41, and screwed into the substrate 20. The mounting openings 44 are spaced periodically to provide the strength and stability requirements to properly secure the mounting member 40 to the panel substrate 20.

Figure 7:
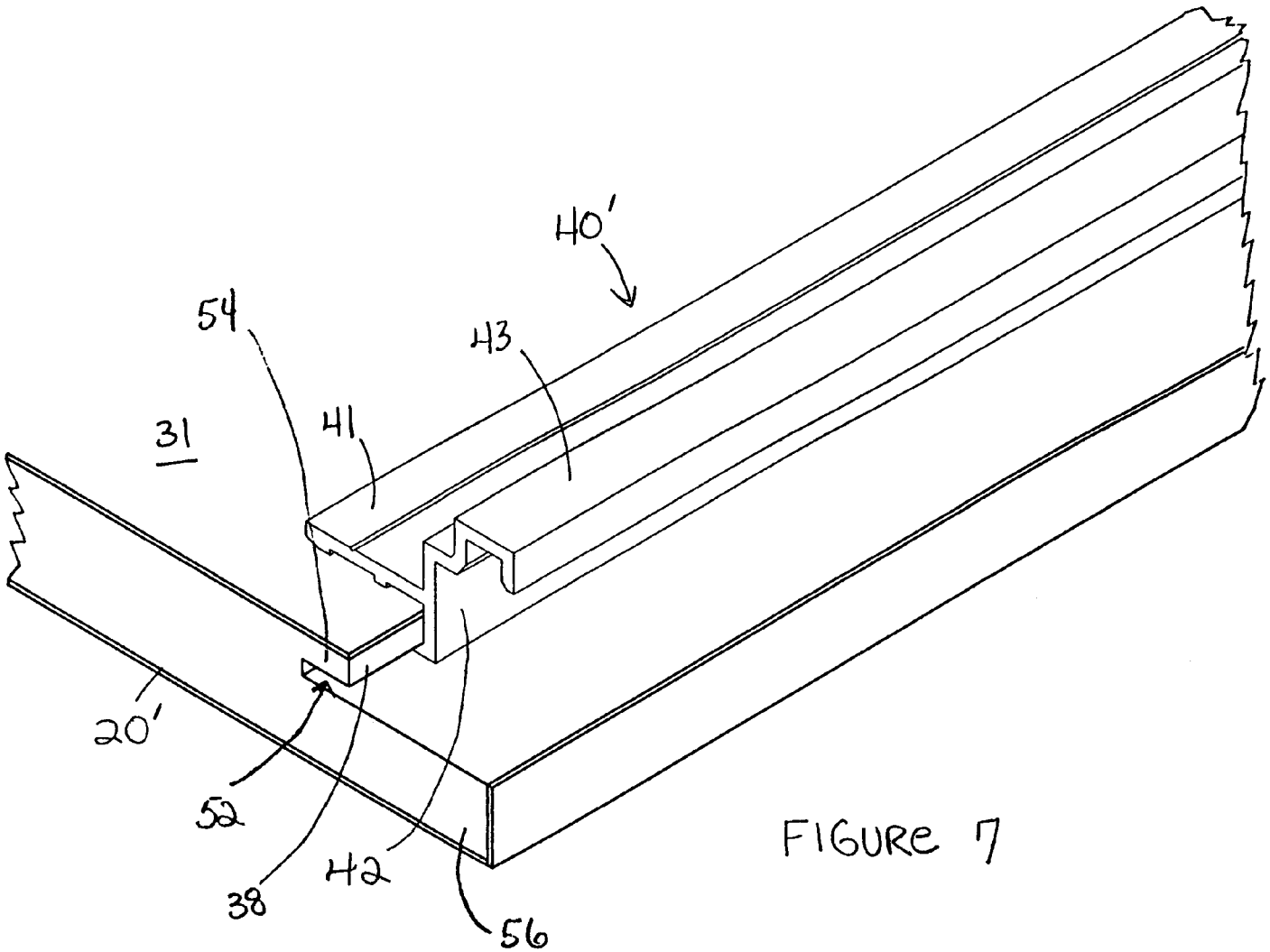
FIG. 7 is a fragmentary perspective view of the alternate mounting member of FIGS. 5 and 6 attached to a substrate having a kerfed edge.
Figure 8:
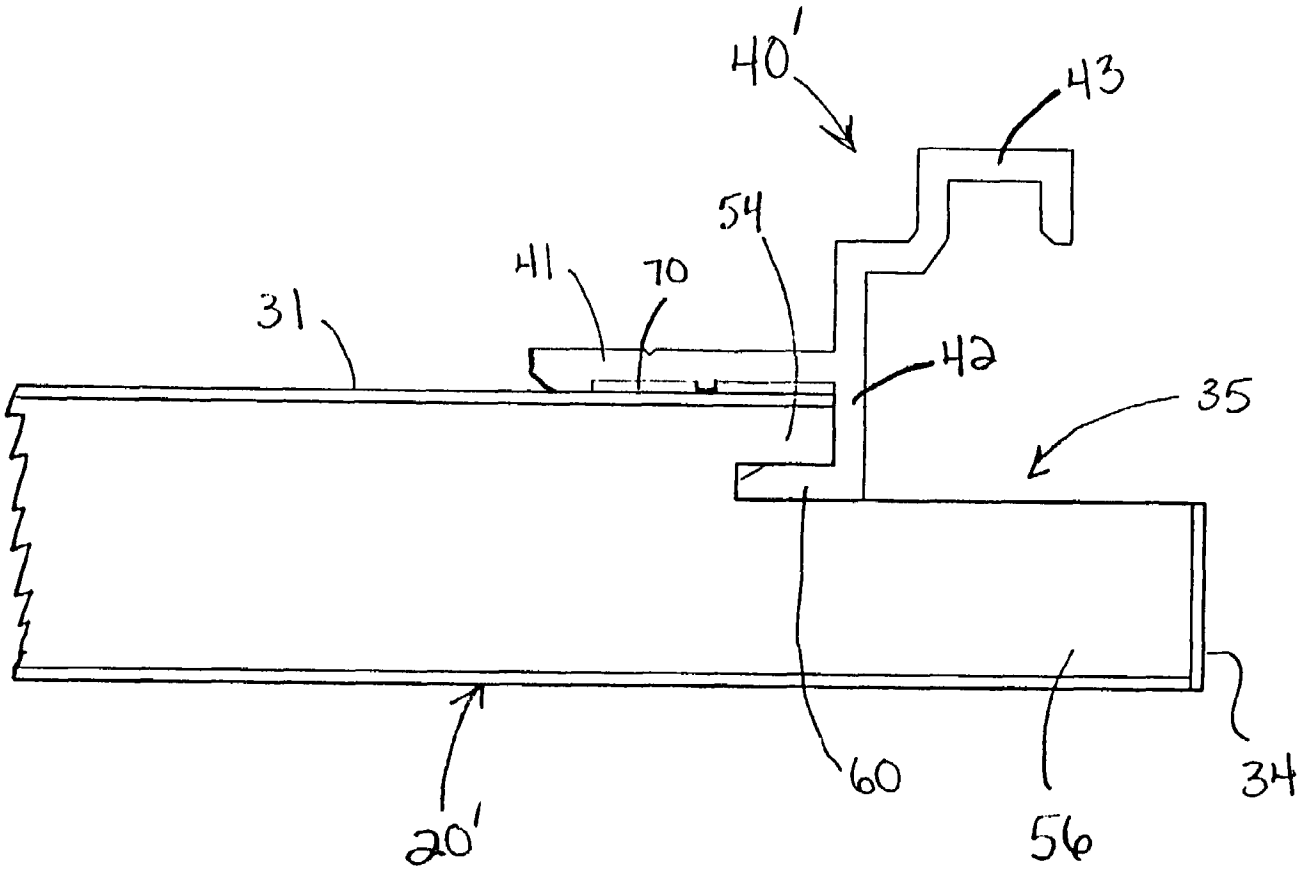
FIG. 8 is a fragmentary horizontal view of FIG. 7.

In an alternative example embodiment, as shown in FIGS. 5-8, a recess is formed in the bottom surface of the attachment section 41, such that when the attachment section 41 is positioned on the panel substrate 20, only portions of the attachment section 41 are in direct contact with the first major surface 31. Consequently, as best shown in FIG. 8, at least one clearance 70 is formed between the attachment section 41 and the first major surface 31. This clearance 70 is advantageous in that it provides a space for tear out, e.g. wood shavings, which may accumulate when a fastener is screwed into a panel substrate 20 to attach the mounting member 40 to the substrate 20. Absent this clearance 70, the accumulated tear may push up on the attachment section 41 to the extent that it will either deform the attachment section 41 or at least move the mounting member away from the panel substrate. As a result, the panel substrate 20 will not be mounted precisely horizontal and in parallel alignment with the horizontal ceiling plane.

In either example configuration of the mounting member 40, the hook section 43 extends outwardly from the locating section in a direction opposite the attachment section, above its respective recess 35, 36. As best shown in FIG. 8, the hook section 43 extends short of its respective edge 34, so that when the ceiling panel is mounted onto a grid element, the panel substrate 20 will at least substantially cover the bottom support of the grid element 22 when the ceiling is viewed from below.

As shown in FIG. 2, when the mounting member 40 is mounted onto a grid element 22, a receiving cavity 46 is formed which allows for ease in installing neighboring ceiling panels from below the ceiling plane. The bottom of the receiving cavity 46 is formed by bottom surface 37 of the edge recess. The side of the receiving cavity 46 is formed by the locating section 42 alone, as shown in FIG. 8, or by a combination of locating section 42 and interior wall 38, as shown in FIG. 2. The top of cavity 46 is formed by hook section 43 and the bottom surface of bottom support 27 of the grid element 22.

Figure 9:
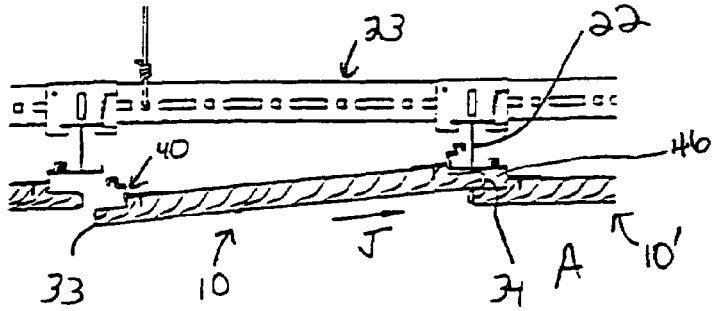
FIGS. 9A through 9D are schematic elevated horizontal views showing the progressive steps of installing a ceiling panel. For illustrative purposes, the ceiling panels of the first example embodiment are shown.
Figure 9:
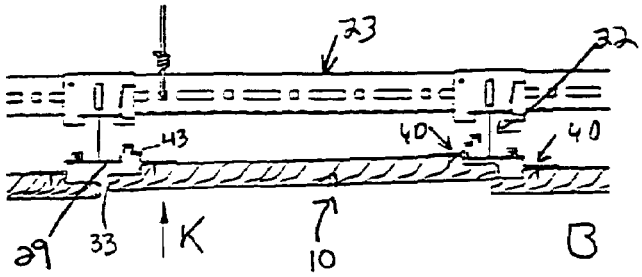
Figure 9:
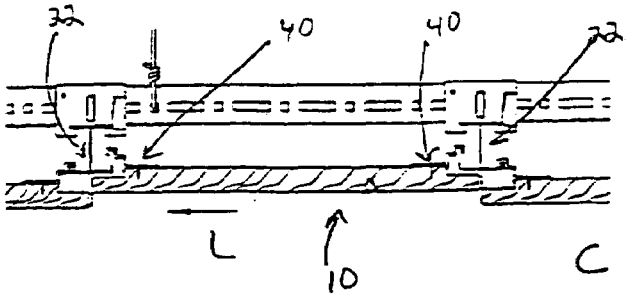
Figure 9:
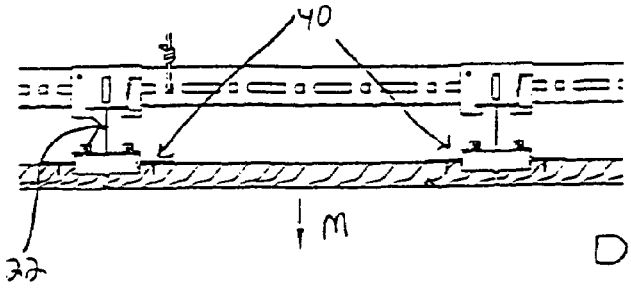

Referring to FIGS. 9A through 9D, the installation process will be described in more detail. As shown in FIG. 9A, ceiling panel 10 is brought upwardly toward a first grid element 22 in an inclined position with a respective panel substrate edge 34 uppermost. It is important to note that the orientation of the edge 34 as the uppermost edge is merely shown for illustrative purposes, and that the positioning of opposing edge 33 in the uppermost position is equally as beneficial. Arrow J denotes the angle and motion of edge 34 as it is being positioned. As the motion indicated by arrow J continues, edge 34 is moved into the receiving cavity 46 formed by an adjacent installed ceiling panel 10' until flange 29 of the grid element 22 abuts the locating section 42, as shown in FIG. 9A. The vertical height of the receiving cavity 46 must provide space sufficient for the angled insertion of the ceiling panel substrate 20 designed for the system.

The ceiling panel 10 is then pivoted to bring the trailing edge 33 upward, as indicated by arrow K in FIG. 9B, until its respective hook section 43 is positioned above its respective flange 29. Referring to FIG. 9C, the ceiling panel 10 is next moved in the direction of arrow L. This movement continues until the edges 33 and 34 do not overlap the edges of the adjacent panel substrates. Next, as shown in FIG. 9D, the ceiling panel 10 is moved in the direction of arrow M until both hook sections 43 engage their respective grid flanges 29 and cause the grid flanges 29 to be seated therein.

As the mounting members 40 are precisely positioned on the panel substrate 20, as was earlier described, the cooperation of the hook sections 43 with the flanges 29 precisely positions the panel substrate 20 relative to the grid, thereby insuring that the spacing between the panel substrates will be accurately controlled, adding to the overall aesthetic appeal of the ceiling. If the ceiling panel 10 is misaligned when it is moved into the position shown in FIG. 9D, the hook sections 43 will not properly seat on the flanges 29 and the installer will know instantly that the panel 20 has not been properly aligned. This provides the installer with immediate feedback and insures that the quality of the installation will be maintained. While the manufacturing tolerances of the flanges 29 and hook sections 43 are adequately controlled, some play must be provided between the flanges 29 and the hook sections 43 to allow for-installation.

Figure 10:
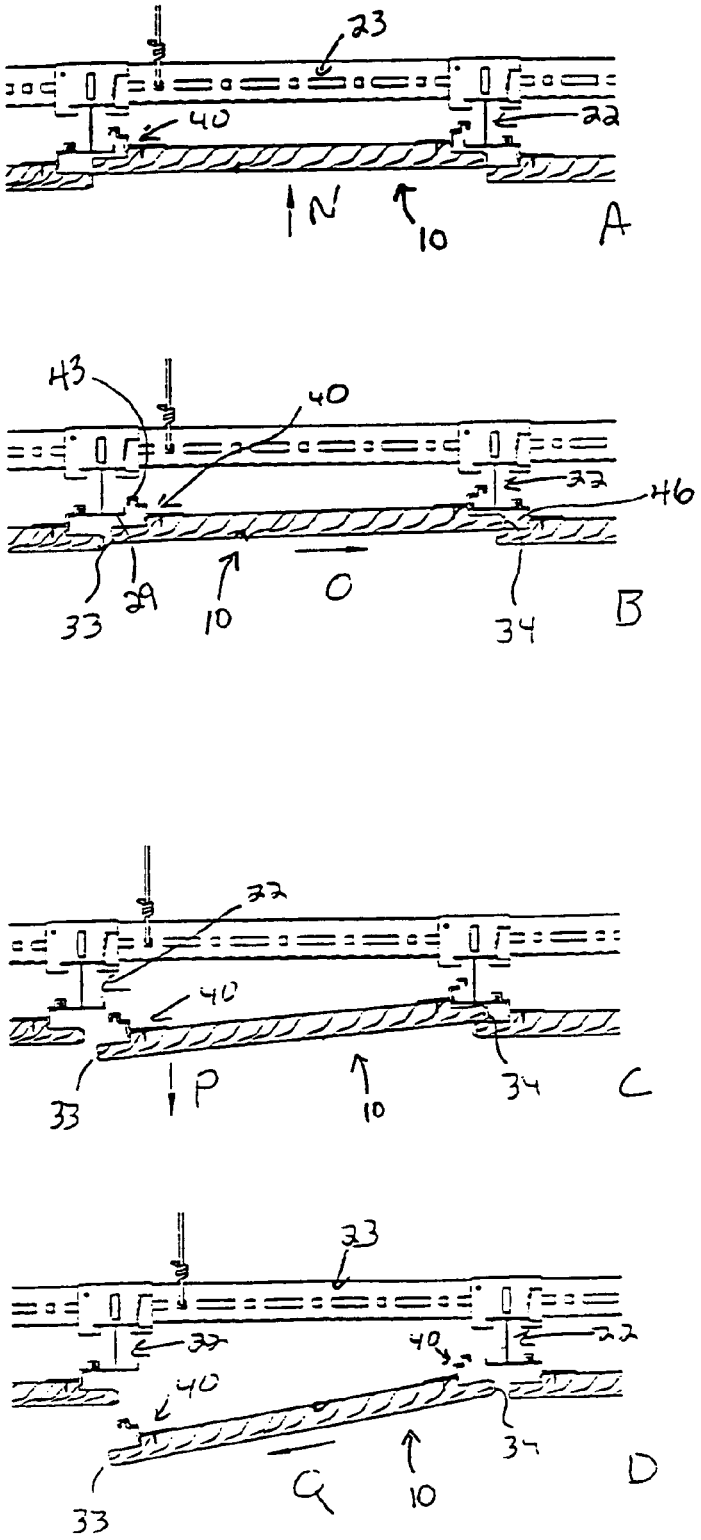
FIGS. 10A through 10D are schematic elevated horizontal views showing the progressive steps of removing a ceiling panel. For illustrative purposes, the ceiling panels of the first example embodiment are shown.

To remove a respective ceiling panel 10 from the grid framework, essentially the reverse of the installation process is followed. As shown in FIG. 10A, the ceiling panel 10 is first lifted upward in the direction indicated by arrow N. As this occurs, the hook sections 43 are disengaged from the flanges 29. The hook sections 43 are maintained in a position above the plane of the flanges 29. The panel 10 is then moved in the direction of arrow O of FIG. 10B, causing the edge 34 to be moved into the cavity 46. With edge 34 positioned in the cavity 46, the respective hook section 43 of the trailing edge 33 is moved out of alignment with its flange 29. The trailing edge 33 is then pivoted downward, as indicated by arrow P of FIG. 10C, until the trailing edge 33 is moved downward beyond the horizontal plane of the ceiling. The panel 10 is then completely removed from the ceiling by moving the panel 10 in the direction of arrow Q shown in FIG. 10D.

As the removal process requires various coordinated movement to easily remove the panel from the grid, the possibility of accidental or inadvertent removal is minimized.

For example, if only one edge of the panel is moved upward, the hook section at the other edge maintains engagement with the flange, thereby preventing the panel from being moved in the direction indicated by arrow O in FIG. 10B. Consequently, the panel 10 will not be removed unless all of the steps recited above are followed. The insertion and removal process of the panels allows the panels to be inserted and removed as required with no damage to the panels or the grids. If a panel is damaged, it can easily be replaced by a comparable panel. The ability to install and remove the panels from below the plane of the ceiling is an advantageous feature of the ceiling.

As shown in FIG. 2, a gasket 39 can be used to fill in any clearance between adjacent panel substrates 20. The gasket can be made of foam, rubber or any other known material that has the ability to conform to the space between the edges of the adjacent panel substrates 20. However, the use of a gasket 39 is not always required or needed.

Various other alternative materials, securing methods, profiles and configurations can be used without departing from the scope of the invention. Those skilled in the relevant art will recognize that many changes can be made to the embodiments described while still obtaining the beneficial results of the present invention. It will also be apparent that some of the desired benefits of the invention can be obtained by selecting some of the features of the present invention without utilizing other features. Thus, the matter set forth in the foregoing description and accompanying drawings is provided as illustrative of the principles of the present invention and not in limitation thereof. For example, the invention can utilize panel substrates with shapes other than rectangular as long as they have opposed edges.

Additionally, FIG.13 illustrates an alternate embodiment of the ceiling panel configuration. In this example embodiment, each panel substrate 20 has a pair of narrow recesses 50 which are offset from, and extend parallel to edges 33, 34. The recesses 50 are precisely positioned with respect to the edges and are configured to cooperate with the locating section 42 of the mounting members 40 as shown in FIG. 13. The mounting members 40 are positioned on the panel 20 such that the base of the locating section 42 is seated in the recess 50.

As was previously described, the hook sections 43 cooperate with the flanges 29 to suspend the ceiling panels in a similar manner. The ceiling panels shown in FIG. 13 are spaced from each other a sufficient distance and the panels 20 do not present the same type of seamless appearance as previously described. A recess 35, 36, as previously described herein, is not required as the spacing between panels 20 is sufficient for purposes of installation. Upon insertion and removal of the panels 20 from below, the panels can freely rotate a sufficient distance without contacting adjacent panels. Although the panels 20 are spaced further apart, the spacing of the panels must be precisely maintained to provide the visual appearance desired. To that end, the hook sections 43 and flanges 29 cooperate in the same manner to insure that the precise spacing of the panels 20 is achieved.

Referring to FIGS. 11 and 12, additional bracing may be provided when the panel substrate 20 is of sufficient size or weight that the mounting members 40 can not alone adequately support the panel substrate 20. The additional bracing elements 47 can be attached to a panel substrate 20 by any conventional means, i.e. screws, adhesive, etc. A safety wire 49 may be provided which extends from the fixed ceiling to the bracing element 47. The safety wire 49 generally has slack provided therein and is provided to prevent the free fall of the ceiling panel in instances where the panel may accidentally come loose from the grid framework. The additional bracing elements 47 may extend in a direction perpendicular (FIG. 7) or parallel (FIG. 12) to the mounting members 40, depending on the configuration of the respective panels.

FIGS. 7 and 8 illustrate yet another embodiment of the panel substrate and mounting member. In this example configuration, the panel substrate 20' may include at least one kerf 52 extending inwardly from the vertical interior wall 38 in a direction substantially perpendicular thereto. Kerf 52 defines a top edge portion 54 and a bottom edge portion 56. In this configuration, mounting member 40', in addition to the components of the first example embodiment, includes a tab 60 which extends from locating section 42 below the attachment section 41. The spacing between tab 60 and attachment section 41 is greater, if only slightly, than the width of top edge portion 54.

To attach the mounting member 40' to the panel substrate 20', the tab 60 is inserted into kerf 52. Since the spacing between tab 60 and attachment section 41 is greater than the width of top edge portion 54, the attachment section 41 will be positioned above the top edge portion 54 and form a channel. In the example embodiment shown in FIG. 8, a portion of the attachment section is contiguous the first major surface 31 of the panel substrate 20' such that the mounting member 40' and top edge portion 54 of the panel substrate 20' are in sliding engagement.

In this configuration, it is not necessary to positively attach the attachment section 41 to the panel substrate 20' for the purpose of supporting the weight of the panel substrate 20'. Here, the tab 60 performs this function. However, a screw-type fastener may be inserted through the mounting openings and into the panel substrate to prevent excessive movement of the mounting member from the panel substrate and to ensure that the mounting member will not become fully dislodged from the panel substrate. By not tightening these fasteners completely, some play will be provided, such that the panel substrate will be permitted to expand and contract due to humidity, water exposure and the like. In turn, this will prevent warping and cupping of the panel substrate 20.

What is claimed is:

1. A ceiling panel and mounting member combination comprising:

a substrate having a first major surface, a second major surface and at least two edges extending therebetween, the substrate further including first and second recesses extending from the first major surface in a direction toward the second major surface, each recess having an interior wall and a bottom surface;

a first mounting member having a first mounting member locating section and a second mounting member having a second mounting member locating section, the first mounting member locating section cooperating with and engaging the interior wall of the first recess to precisely locate the first mounting member on the panel substrate, the second locating section cooperating with and engaging the interior wall of the second recess to precisely locate the second mounting member on the panel substrate, each of the first and second mounting members further include a hook section which cooperates with a ceiling grid member to mount the ceiling panel to a ceiling grid;

wherein each mounting member has an attachment section that is attached to the substrate at the first major surface of the substrate; and wherein each mounting member is positioned on the panel substrate such that the bottom surface of the attachment section abuts the first major surface and the locating section abuts the interior wall.

2. The ceiling panel and mounting member combination of claim 1, wherein first and second edges of the at least two edges are oppositely facing and parallel to each other, the interior wall of each recess is offset from the first and second edges and is positioned parallel thereto.

3. The ceiling panel and mounting member combination of claim 2, wherein the bottom surface of each recess is offset from the first major surface and is positioned parallel thereto.

4. The ceiling panel and mounting member combination of claim 1, wherein the attachment section imparts strength and rigidity characteristics to the panel substrate which minimizes the propensity of the panel substrate to sag.

5. The ceiling panel and mounting member combination of claim 1, wherein the attachment section is contiguous the first major surface of the panel substrate.

6. The ceiling panel and mounting member combination of claim 1, wherein at least one clearance is formed between the attachment section and the first major surface of the panel substrate.

7. The ceiling panel and mounting member combination of claim 1, wherein the substrate includes a kerf extending inwardly from the interior wall, the kerf defining a top edge portion and a bottom edge portion of the substrate.

8. The ceiling panel and mounting member combination of claim 7, wherein the mounting member includes a tab which extends from the locating section and is spaced from and positioned below the attachment section, the tab being positioned in the kerf.

9. The ceiling panel and mounting member combination of claim 8, wherein the spacing between the tab and the attachment section is greater than the width of the top edge portion, the attachment section being contiguous the first major surface.

10. The ceiling panel and mounting member combination of claim 1, wherein the mounting member is attached to the panel substrate by a chemical adhesive.

11. The ceiling panel and mounting member combination of claim 1, wherein the panel substrate is made from a material selected from the group consisting of mineral fiber board, fiberglass, wood, metal, plastic and combinations thereof.

12. The ceiling panel and mounting member combination of claim 11, wherein the mounting members are made from extruded aluminum.

13. A ceiling panel and mounting member combination comprising:

a substrate having a first major surface, a second major surface and at least two edges extending therebetween, the substrate further including first and second recesses extending from the first major surface in a direction toward the second major surface, each recess having an interior wall and a bottom surface;

a first mounting member having a first mounting member locating section and a second mounting member having a second mounting member locating section, the first mounting member locating section cooperating with and engaging the interior wall of the first recess to precisely locate the first mounting member on the panel substrate, the second locating section cooperating with and engaging the interior wall of the second recess to precisely locate the second mounting member on the panel substrate, each of the first and second mounting members further include a hook section which cooperates with a ceiling grid member to mount the ceiling panel to a ceiling grid;

wherein each mounting member has an attachment section that is attached to the substrate at the first major surface of the substrate; and wherein the attachment section has openings extending therethough in which a mechanical fastener can be received.

14. The ceiling panel and mounting member combination of claim 13, further including a mechanical fastener positioned in at least one of the openings and extending through the panel substrate.

15. The ceiling panel and mounting member combination of claim 14, wherein the mechanical fastener supports the weight of the panel substrate when the ceiling panel is mounted a ceiling grid.

16. The ceiling panel and mounting member combination of claim 14, wherein the mechanical fastener is a screw-type fastener.

17. A ceiling panel system comprising:

a grid network having a plurality of grid members positioned in parallel relation to one another, each grid member having a support member and flanges extending from the ends of the support member;

a ceiling panel having a substrate and first and second mounting members, the substrate having at least two opposing edges extending between a first major surface and a second major surface, the first and second mounting members each having an attachment section and a locating section which cooperate with an opposed edge of the substrate to precisely locate each of the mounting member on an opposed edge of the panel, the mounting member further including a hook section which precisely mounts the ceiling panel to one of the plurality of grid members, wherein a recess extends from the first major surface of the panel substrate toward the second major surface of the panel, the recess having an interior wall which is precisely located on the first major surface, and wherein the interior wall of the recess is offset from the at least two opposing edges and is positioned parallel thereto.

18. The ceiling panel system of claim 17 wherein the attachment section directly cooperates with the first major surface of the panel substrate to secure and maintain the mounting member in position on the panel substrate.

19. The ceiling panel system of claim 18, wherein at least one clearance is formed between the attachment section and the first major surface of the panel substrate.

20. The ceiling panel system of claim 17, wherein the mounting members provide bracing to the panel substrate.

* * * * *